US010522934B2

(12) United States Patent
Zhang et al.

(10) Patent No.: US 10,522,934 B2
(45) Date of Patent: Dec. 31, 2019

(54) CONNECTION TERMINAL AND CONNECTION ASSEMBLY

(71) Applicant: Tyco Electronics (Shanghai) Co. Ltd., Shanghai (CN)

(72) Inventors: Yueou Zhang, Shanghai (CN); Haomai Yin, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/364,956

(22) Filed: Nov. 30, 2016

(65) Prior Publication Data

US 2017/0155205 A1 Jun. 1, 2017

(30) Foreign Application Priority Data

Nov. 30, 2015 (CN) ..... 2015 1 0861147
Nov. 30, 2015 (CN) ..... 2015 2 0976358 U

(51) Int. Cl.
*H01R 13/432* (2006.01)
*H01R 24/28* (2011.01)

(52) U.S. Cl.
CPC ..... *H01R 13/432* (2013.01); *H01R 24/28* (2013.01)

(58) Field of Classification Search
CPC ..... H01R 13/113; H01R 43/16; H01R 13/04; H01R 13/432; H01R 13/187; H01R 13/642; H01R 4/185; H01R 13/03; H01R 13/17; H01R 13/193; H01R 13/4223; H01R 13/424; H01R 13/428; H01R 2201/26;

(Continued)

(56) References Cited

U.S. PATENT DOCUMENTS 5,266,056 A * 11/1993 Baderschneider ... H01R 13/432 439/745
5,489,223 A * 2/1996 Faje ..... H01R 13/432 439/748

(Continued)

FOREIGN PATENT DOCUMENTS

DE 8608199 5/1986
EP 0708494 4/1996

(Continued)

*Primary Examiner* — Edwin A. Leon
*Assistant Examiner* — Matthew T Dzierzynski
(74) *Attorney, Agent, or Firm* — Faegre Baker Daniels LLP

(57) ABSTRACT

The present invention discloses a connection terminal and a connection assembly. The connection assembly has the connection terminal and a housing. The connection terminal has a body, a plug-in portion, and a wire connecting portion. The plug-in portion and the wire connecting portion are disposed at two ends of the body respectively. The body is provided with a primary locking portion, which has a connection portion, a first stopping portion, and a reinforcing portion. The connection portion is disposed on the body. The first stopping portion is disposed on the connection portion, and extends in a direction opposite to a plug-in direction. The reinforcing portion is disposed on the first stopping portion, and extends continuously along the plug-in direction of the connection terminal to the connection portion. The connection terminal of the present invention has high mechanical strength and a high pressure-bearing capability, so as to be securely mounted in the housing.

26 Claims, 13 Drawing Sheets

(58) Field of Classification Search
CPC ..... H01R 13/11; H01R 13/112; H01R 13/18; H01R 13/35; H01R 13/41; H01R 13/4362; H01R 13/5205; H01R 13/629; H01R 24/28; H01R 24/76; H01R 43/0221; H01R 4/184; H01R 4/28
USPC ..... 439/852, 845, 839, 843, 850, 856, 867
See application file for complete search history.

(56) References Cited

U.S. PATENT DOCUMENTS 5,997,363 A * 12/1999 Joly ..... H01R 13/521 439/748
6,024,612 A * 2/2000 Myer ..... H01R 13/113 439/744
6,126,495 A * 10/2000 Lolic ..... H01R 13/18 439/752.5
6,165,026 A * 12/2000 Sugie ..... H01R 13/432 439/746
6,811,436 B2 * 11/2004 Tabata ..... H01R 13/642 439/595
6,997,761 B2 * 2/2006 Lutsch ..... H01R 13/17 439/866
7,976,351 B2 * 7/2011 Boemmel ..... H01R 13/432 439/748
8,708,719 B2 * 4/2014 Iihoshi ..... H01R 13/434 439/131
9,153,879 B2 * 10/2015 Frimmersdorf ..... H01R 4/28
9,799,976 B2 * 10/2017 Lehner ..... H01R 43/16
2004/0253881 A1 12/2004 Sakurai
2017/0047677 A1 * 2/2017 Bhagyanathan Sathianathan ..... H01R 13/113

FOREIGN PATENT DOCUMENTS

EP 1526608 4/2005
JP H10189119 7/1998
JP 2002093508 3/2002
JP 2003022875 1/2003

* cited by examiner

CONNECTION TERMINAL AND CONNECTION ASSEMBLY

PRIORITY CLAIM

The present application claims priority to Chinese patent applications CN 201510861147.4 and CN 201520976358.8 both filed Nov. 30, 2015, the subject matter of which is incorporated herein by reference.

TECHNICAL FIELD

The present invention relates to connection members, and particularly to a connection terminal and a connection assembly.

BACKGROUND

A connection terminal is used to implement electrical connection between different electronic components. For ease of assembly, insulation, fixation, or the like, the connection terminal is usually disposed in a connector housing. Correspondingly, a corresponding stopping structure is usually disposed in the connector housing to fix the connection terminal. The connection terminal is correspondingly provided with a secure mounting structure, so as to be securely disposed in the connector housing.

SUMMARY OF THE INVENTION

An objective of the present invention is to eliminate defects in the prior art, and provide a connection terminal that has high mechanical strength and that can be securely connected and a connection assembly.

To achieve the objective, the present invention is implemented by using the following technical solutions.

A connection terminal, including a body, a plug-in portion, and a wire connecting portion, where the plug-in portion and the wire connecting portion are disposed at two ends of the body respectively; the body is provided with a primary locking portion; the primary locking portion includes a connection portion, a first stopping portion, and a reinforcing portion; the connection portion is disposed on the body; the first stopping portion is disposed on the connection portion, and extends in a direction opposite to a plug-in direction; and the reinforcing portion is disposed on the first stopping portion, and extends continuously along the plug-in direction of the connection terminal to the connection portion.

Preferably, the connection portion is provided with a retreat prevention protrusion portion, and the retreat prevention protrusion portion extends along the plug-in direction of the connection terminal, so as to stop the plug-in portion on the connection terminal from retreating.

Preferably, the first stopping portion includes: a parallel segment, wherein the parallel segment is parallel to the connection portion; and an inclined segment, wherein the inclined segment is disposed at an end portion of the parallel segment, and extends along a direction where an included angle between the direction and the plug-in direction of the connection terminal is an obtuse angle, wherein the inclined segment is offset by a force during plugging in, so that the included angle between the inclined segment and the plug-in direction of the connection terminal increases.

Preferably, a free end of the first stopping portion is provided with a guide slot, and the guide slot is used to, when squeezed by an obstacle, guide the obstacle to slide to an upper portion of the first stopping portion.

Preferably, a free end of the first stopping portion is provided with a protruding platform, and a rear end surface of the protruding platform is a stopping surface.

Preferably, a free end of the first stopping portion has a stopping surface, and the stopping surface is perpendicular to the plug-in direction of the connection terminal.

Preferably, the body includes a support base, and a mounting side wall and a support wall that are disposed on two sides of the support base, and the connection portion is disposed on the support wall, and extends toward the mounting side wall.

Preferably, the connection portion has a first protrusion portion disposed in a protruding manner, and the first protrusion portion extends toward the mounting side wall; the mounting side wall is provided with a first support hole, and the first support hole is a blind hole or a through hole that is disposed on an inner side of the mounting side wall and that extends toward an outer side; and the first protrusion portion is inserted into the first support hole, so as to connect the connection portion to the mounting side wall.

Preferably, a clearance fit is formed by the first protrusion portion and a hole wall of the first support hole.

Preferably, a lower portion of the first support hole is provided with an inward recessed portion, and an upper portion of the inward recessed portion is in contact with the first protrusion portion.

Preferably, one side of the first stopping portion is provided with a bent side arm, and the bent side wall is bent toward the support base.

Preferably, the support wall is provided with a support protrusion portion, which extends toward the bent side arm, and directly faces the bent side arm.

Preferably, the first stopping portion has an upper portion and a lower portion that are opposite to each other, the back of the upper portion faces the support base, the lower portion directly faces the support base, and the reinforcing portion includes a recessed portion that recesses downward from the upper portion of the first stopping portion.

Preferably, the reinforcing portion further includes a protruding portion that protrudes downward from the lower portion of the first stopping portion.

Preferably, the first stopping portion has an upper portion and a lower portion that are opposite to each other the back of the upper portion faces the support base, the lower portion directly faces the support base, and the reinforcing portion includes a protruding portion that protrudes upward from the upper portion of the first stopping portion.

Preferably, the reinforcing portion is obtained through stamping.

Preferably, the mounting side wall is further provided with a retaining notch, a retaining protrusion portion is disposed on a corresponding side of a free end of the first stopping portion in a protruding manner, and the retaining protrusion portion extends into the retaining notch.

Preferably, the free end of the first stopping portion is provided with a protruding platform, and an upper surface of the retaining protrusion portion and an upper surface of the protruding platform are coplanar.

Preferably, the retaining notch is formed by a retaining hole wall disposed on the mounting side wall, and a height of a bottom edge of the retaining hole wall is set so that when the bottom edge of the retaining hole wall comes into contact with the retaining protrusion portion, the bottom edge of the retaining hole wall prevents the first stopping portion from being excessively offset.

Preferably, a limiting portion is disposed on the other side of the first stopping portion in a protruding manner; the mounting side wall is provided with a limiting hole, and the limiting hole is a through hole or a blind hole that is disposed on an inner side of the mounting side wall and that extends toward an outer side; the limiting portion is inserted into the limiting hole; and the limiting hole is used to limit a movement range of the limiting portion, so as to limit a range of a distance from the first stopping portion to the support base.

Preferably, the limiting hole is disposed so that in a direction parallel to the support base, a distance from a center of the limiting hole to a free end of the first stopping portion is less than a distance from the center of the limiting hole to a disposed end.

Preferably, the limiting hole is formed by a limiting hole wall disposed on the mounting side wall, and a front edge of the limiting hole wall is disposed so that when the first stopping portion is offset downward by a force, the front edge of the limiting hole wall comes into contact with the limiting portion on the first stopping portion, so as to prevent the first stopping portion from being excessively offset.

Preferably, the connection terminal further includes a second stopping portion; the second stopping portion is disposed on the support wall in a protruding manner; the second stopping portion and the first stopping portion are successively arranged along the plug-in direction of the connection terminal; and a maximum height from the second stopping portion to the support base is less than a height from a free end of the first stopping portion to the support base.

Preferably, the second stopping portion extends toward the mounting side wall, and has a protruding disposed portion; the mounting side wall is provided with a second support hole, and the second support hole is a blind hole or a through hole that is disposed on an inner side of the mounting side wall and that extends toward an outer side; and the protruding disposed portion is inserted into the second support hole.

Preferably, a clearance fit is formed between the protruding disposed portion and a hole wall of the second support hole.

Preferably, the connection terminal further includes a third stopping portion, and the third stopping portion is disposed on the support base; the third stopping portion, the second stopping portion, and the first stopping portion are successively arranged along the plug-in direction of the connection terminal; and the third stopping portion directly faces a rear portion of the second stopping portion, and a projection area of the third stopping portion on a cross section of the connection terminal is greater than a projection area of the second stopping portion on the cross section of the connection terminal.

Preferably, the third stopping portion extends from the mounting side wall to the support wall; the support wall is provided with a limiting notch; and the third stopping portion is inserted into the limiting notch.

Preferably, a lateral clearance is disposed between the primary locking portion and the mounting side wall, and the lateral clearance is uniform along the plug-in direction of the connection terminal.

Preferably, the support wall includes an inclined end surface, and the inclined end surface is located at a junction of the support wall and the primary locking portion, and is inclined downward and backward.

Preferably, the connection terminal is a single piece. Preferably, the connection terminal is stamped from one brass sheet.

A connection terminal, including a body, a plug-in portion, and a wire connecting portion, where the plug-in portion and the wire connecting portion are disposed at two ends of the body respectively; the body includes a support base, and a mounting side wall and a support wall that are disposed on two sides of the support base; the body is provided with a primary locking portion; the primary locking portion includes a connection portion and a first stopping portion; the connection portion is disposed on the body; the first stopping portion is disposed on the connection portion, and extends in a direction opposite to a plug-in direction; and the first stopping portion is provided with a support portion, and the support portion protrudes from the first stopping portion along a lateral direction, and extends to a position above the mounting side wall or the support wall.

Preferably, the first stopping portion is located between the mounting side wall and the support wall, and the support portion extends from the first stopping portion along the lateral direction, and extends over an inner side surface of the mounting side wall or an inner side surface of the support wall.

Preferably, the support portion is disposed on two lateral sides of the first stopping portion. The support portion can comprise a bent side arm, the bent side arm is connected to the first stopping portion and located on one side of the first stopping portion, and the bent side wall is bent towards the support base.

Preferably, the support portion includes a retaining protrusion portion; the retaining protrusion portion is disposed at a free end of the first stopping portion, and protrudes toward one side of the first stopping portion; the mounting side wall is further provided with a retaining notch; and the retaining protrusion portion extends into the retaining notch.

Preferably, the support portion includes a limiting portion, which is disposed on the first stopping portion, and protrudes toward the other side of the first stopping portion.

A connection assembly, including a housing and the foregoing connection terminal, where the connection terminal is disposed in the housing.

Compared with the prior art, the connection terminal of the present invention has high mechanical strength and a high pressure-bearing capability, so as to be securely mounted in a housing. Preferably, the connection terminal of the present invention is integrally formed by using brass, so that not only manufacturing costs are reduced, but also required mechanical strength is achieved. A mounting side wall of the connection terminal not only provides a correct mounting direction, but also is provided with a corresponding hole and notch to support other parts. In addition, a limiting hole disposed in the mounting side wall provides a supporting point for the first stopping portion subjected to a force, and enables an arm of force of a free end of the first stopping portion to be relatively short, thereby enabling the free end to bear greater pressure. A reinforcing portion on the connection terminal is formed through stamping, thereby improving an anti-bending capability of the first stopping portion. One side of the first stopping portion is provided with a bent side wall, so as to further prevent the first stopping portion from being arched or bent. In addition, a primary locking portion of the connection terminal is in fit with a second stopping portion and a third stopping portion, to form a secondary locking structure, thereby further improving secure mounting performance. A front portion of the primary locking portion of the connection terminal is provided with a retreat prevention protrusion portion, so as to provide a support when a plug-in portion is subjected to a relatively great squeezing force.

BRIEF DESCRIPTION OF DRAWINGS

The following description is set forth in connection with the attached drawing figures, which are not necessarily to scale, emphasis instead generally being placed upon illustrating the principles of the invention. In the drawing figures.

DETAILED DESCRIPTION OF EMBODIMENTS

The present invention is described in detail in the following with reference to the accompanying drawings.

Figure 1:
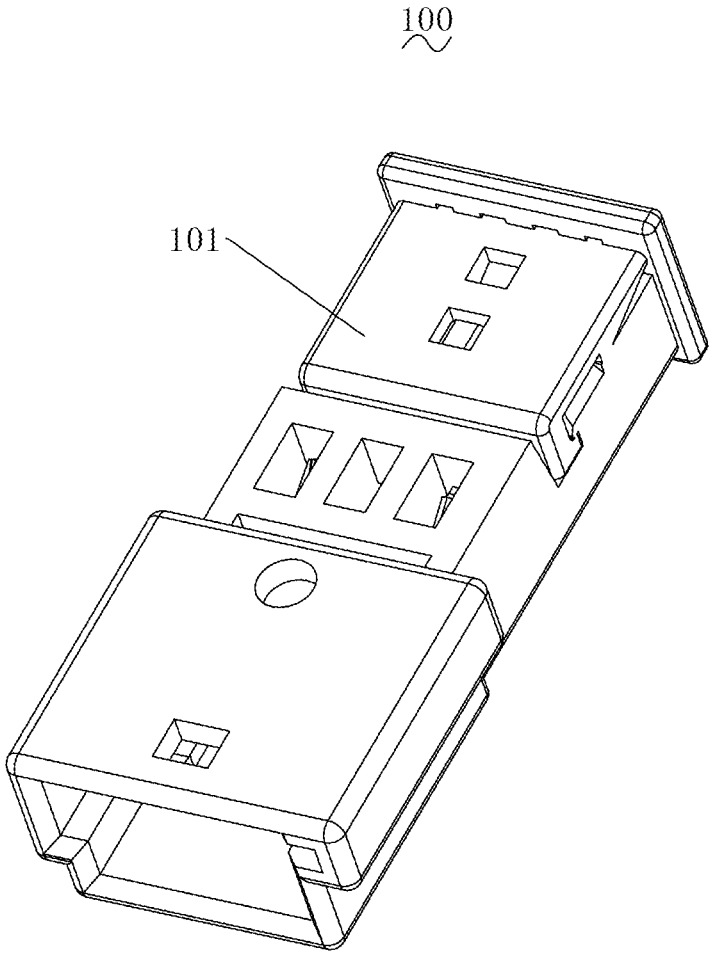
FIG. 1 is a schematic structural view of a connection assembly according to the present invention.
Figure 2:
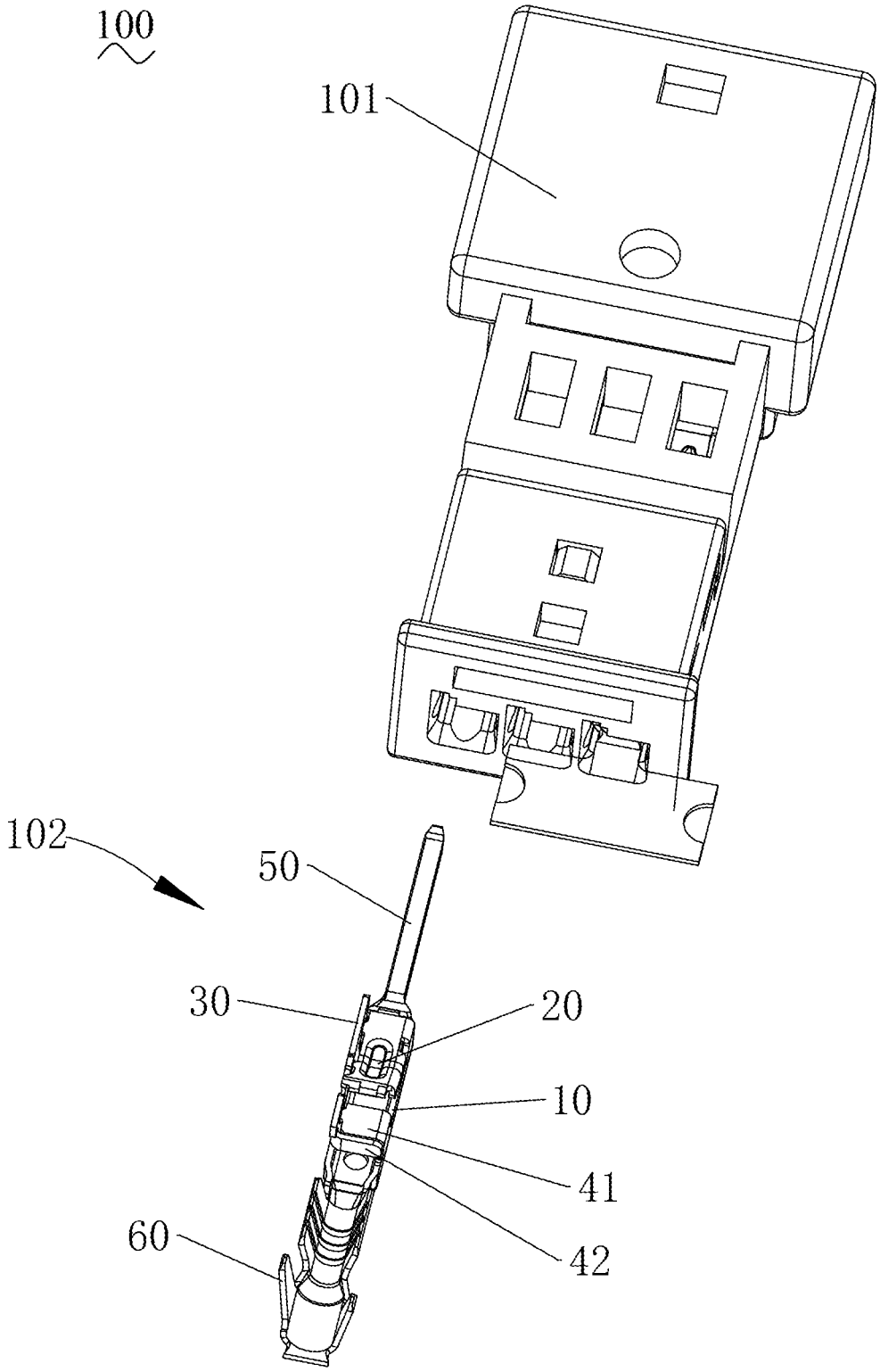
FIG. 2 is an exploded perspective view of a connection assembly in FIG. 1.
Figure 3:
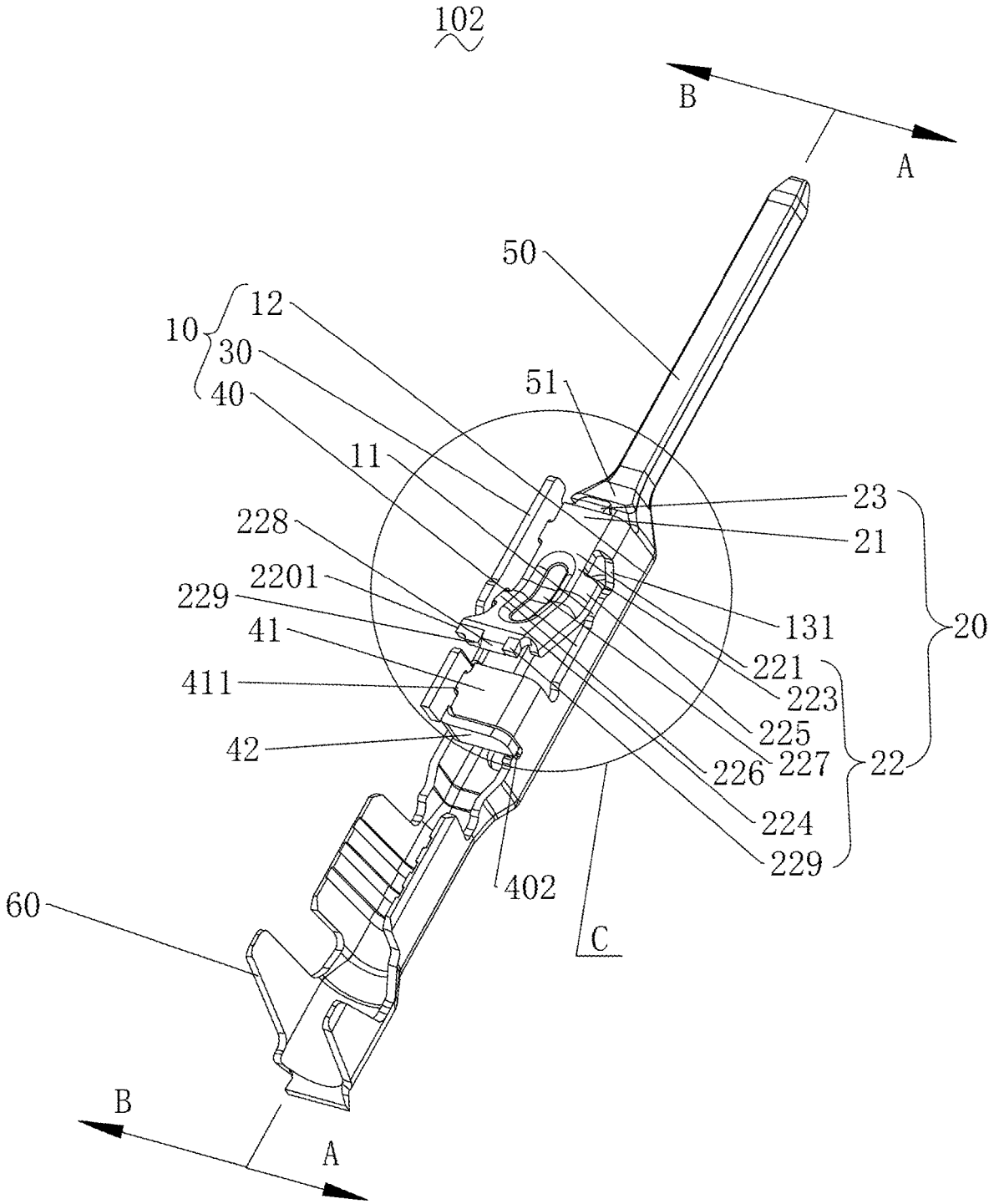
FIG. 3 is schematic structural view I of a connection terminal in FIG. 2.

Referring to FIG. 1 and FIG. 2, which show a connection assembly 100 provided by the present invention. The connection assembly 100 includes a housing 101 and a connection terminal 102 disposed in the housing 101. It is conceivable that the connection assembly 100 may further include a corresponding part for implementing an electrical connection function such as a connecting wire or component, which is of the prior art rather than the focus of the problem to be solved by the present invention, and therefore is not described herein.

The shape and material of the housing 101 are selected according to mounting requirements. The housing 101 may be a single piece formed through injection molding. In this embodiment, an accommodation space for accommodating the connection terminal 102 is disposed in the housing 101. A stopping stricture for fitting with the connection terminal 102 to implement primary locking and secondary locking is disposed in the housing 101. A slot for accommodating the following mounting side wall 30 of the connection terminal 102 is further disposed in the housing 101. The structure and material of the housing 101 are not a focus of the present invention, and therefore are not described herein.

Also referring to FIG. 3 to FIG. 10, the connection terminal 102 includes a body 10, and a plug-in portion 50 and a wire connecting portion 60 that are disposed at two ends of the body 10. The plug-in portion 50 may be electrically connected to a mating terminal, and the wire connecting portion 60 may be connected to a wire. A primary locking portion 20 is disposed on the body 10 of the connection terminal 102, and is used to hold the connection terminal 102 in the housing 101. In an embodiment of the present invention, the body 10 of the connection terminal 102 includes a support base 12, and a mounting side wall 30 and a support wall 40 that are disposed on two sides of the support base 12. Preferably, the body 10 of the connection terminal 102 is formed by performing stamping and bending on a sheet. The primary locking portion 20 of the connection terminal 102 is disposed on the support wall 40. In another preferred embodiment of the present invention, the connection terminal 102 is a single piece, and the body 10, the plug-in portion 50, and the wire connecting portion 60 of the connection terminal 102 are formed by performing stamping and bending on a sheet.

The body 10 extends along a plug-in direction of the connection terminal 102. The body 10 is used to support the primary locking portion 20. The shape and material of the body 10 may be selected according to application needs. In this embodiment, a groove extending along the plug-in direction of the connection terminal 102 is disposed in the body 10. Side walls that form the groove are used to dispose structures such as the primary locking portion 20. Preferably, a support protrusion portion 11 is disposed on a side wall of the body 10 in a protruding manner. The support protrusion portion 11 extends toward a bottom portion of the primary locking portion 20, and directly faces the following bent side arm 225, so as to support the primary locking portion 20 to prevent the primary locking portion 20 from being excessively pushed down. In an embodiment of the present invention, the support protrusion portion 11 is disposed on the support wall 40 on one side of the support base 12. The support wall 40 is disposed on the one side of the support base 12 in a protruding manner. The support wall 40 is lower than the mounting side wall 30. In this embodiment, the support wall 40 includes an inclined end surface 401. The inclined end surface 401 is located at a junction of the support wall 40 and the primary locking portion 20, and is inclined downward and backward, so as to enhance the strength of the connection between the support wall 40 and the primary locking portion 20 to prevent the support wall 40 and the primary locking portion 20 from being broken by a relatively great external force. Preferably, a side wall of the body 10 is further provided with a limiting notch 402. The limiting notch 402 is used to limit movement of the following third stopping portion 42. In another embodiment of the present invention, the limiting notch 402 is disposed at the support wall 40 on the one side of the support base 12.

The primary locking portion 20 includes a connection portion 21 disposed on the body 10, and a first stopping portion 22 and a retreat prevention protrusion portion 23 that are disposed at two ends of the connection portion 21 respectively. The first stopping portion 22, the connection portion 21, and the retreat prevention protrusion portion 23 are successively arranged along the plug-in direction of the connection terminal 102. In a preferred embodiment of the present invention, the connection portion 21 is disposed on one side of the support wall 40, and is bent and extends toward the other side of the support wall 40. A first protrusion portion 211 is disposed on a free end of the connection portion 21 in a protruding manner The first protrusion portion 211 extends into the following first support hole 31 of the mounting side wall 30, and is used to support the connection portion 21, so that the connection portion 21 has a greater pressure-bearing capability, and is unlikely to deform or break, and in addition, laser spot welding that is difficult to perform can be avoided, so that process steps and costs are reduced.

To enhance the pressure-bearing capability of the first stopping portion 22, the first stopping portion 22 is provided with a support portion, and the support portion protrudes from the first stopping portion 22 along a lateral direction, and extends to a position above the mounting side wall 30 or the support wall 40. In order to further enhance the pressure-bearing capability of the first stopping portion 22, the support portion is disposed on two lateral sides of the first stopping portion 22. In this embodiment, the support portion may be a bent side wall 225 disposed on one lateral side of the first stopping portion 22, and a limiting portion 226 and a retaining protrusion portion 2201 that are disposed on the other lateral side. Specific structures of the bent side wall 225, the limiting portion 226, and the retaining protrusion portion 2201, as well as the fitting relationships there between are described in the following. Definitely, the support portion may further be a protruding column, a flange, a protruding plate, or the like, provided that the support portion can be supported by the mounting side wall 30 or the support wall 40. The first stopping portion 22 is located between the mounting side wall 30 and the support wall 40, and the limiting portion 226 and the retaining protrusion portion 2201 extend from the first stopping portion 22 to the left along the lateral direction shown in FIG. 13, and extend over the inner side surface 301 of the mounting side wall, so that after the limiting portion 226 and the retaining protrusion portion 2201 move downward by a distance, the mounting side wall 30 can support the limiting portion 226 and the retaining protrusion portion 2201. The bent side wall 225 extends from the first stopping portion 22 to the right along the lateral direction shown in FIG. 13, and extends over an inner side surface 405 of the support wall, so that the support wall 40 can support the bent side wall 225 after supporting the bent side wall 225 to move downward by a distance.

It should be noted that, the "front end" and "tail end" (or "rear end") mentioned in the present invention refer to a front portion and a rear portion along the plug-in direction of the connection terminal 102. In addition, the plug-in direction of the connection terminal 102 refers to that the connection terminal 102 is plugged in "forward". If not otherwise specified, the "two sides" refer to two sides of the plug-in direction of the connection terminal 102 or two sides of an axial direction of the connection terminal 102. The "one side" refers to one side, on which the mounting side wall 30 is not disposed, of the connection terminal 102, the "other side" refers to one side, on which the mounting side wall 30 is disposed, of the connection terminal 102, and the "one side" is opposite to the "other side". The "disposed end" or "fixed end" mentioned in the present invention refers to that the end portion is fixedly connected to another part or fixedly disposed on a part. The "free end" refers to that the end portion is not connected to another part or can move. The "upper portion", "upper surface", or "top" refers to an upper position in which the connection terminal 102 and the stopping structure in the housing 101 form a fit, that is, a position, in which the primary locking portion 20 is located, on the connection terminal 102. The "lower portion", "lower surface", or "bottom" is relative to the "upper portion", "upper surface", or "top", and refers to a position, in which the body 10 is located, on the connection terminal 102. "An inner side of the mounting side wall 30" refers to a side facing the primary locking portion 20. "An outer side of the mounting side wall 30" refers to a side with the back facing the primary locking portion 20. It should be noted that, the "lateral direction" mentioned in the present invention is perpendicular to the plug-in direction of the connection terminal 102, and a plane formed by the "lateral direction" and the "plug-in direction" is parallel to the support base 12, and the lateral direction is a left-right direction shown in FIG. 12.

Figure 4:
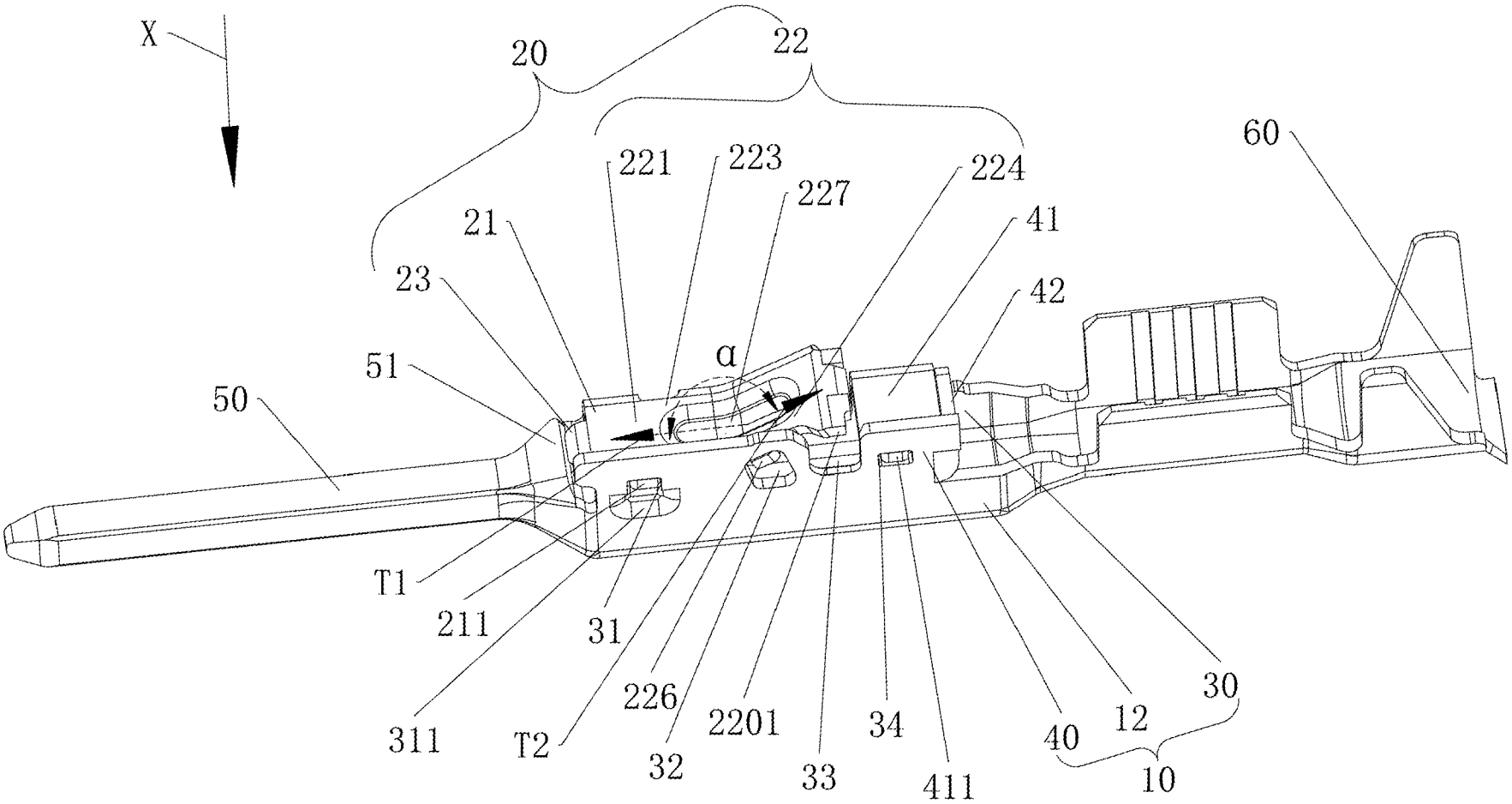
FIG. 4 is schematic structural view 2 of a connection terminal in FIG. 2.
Figure 11:
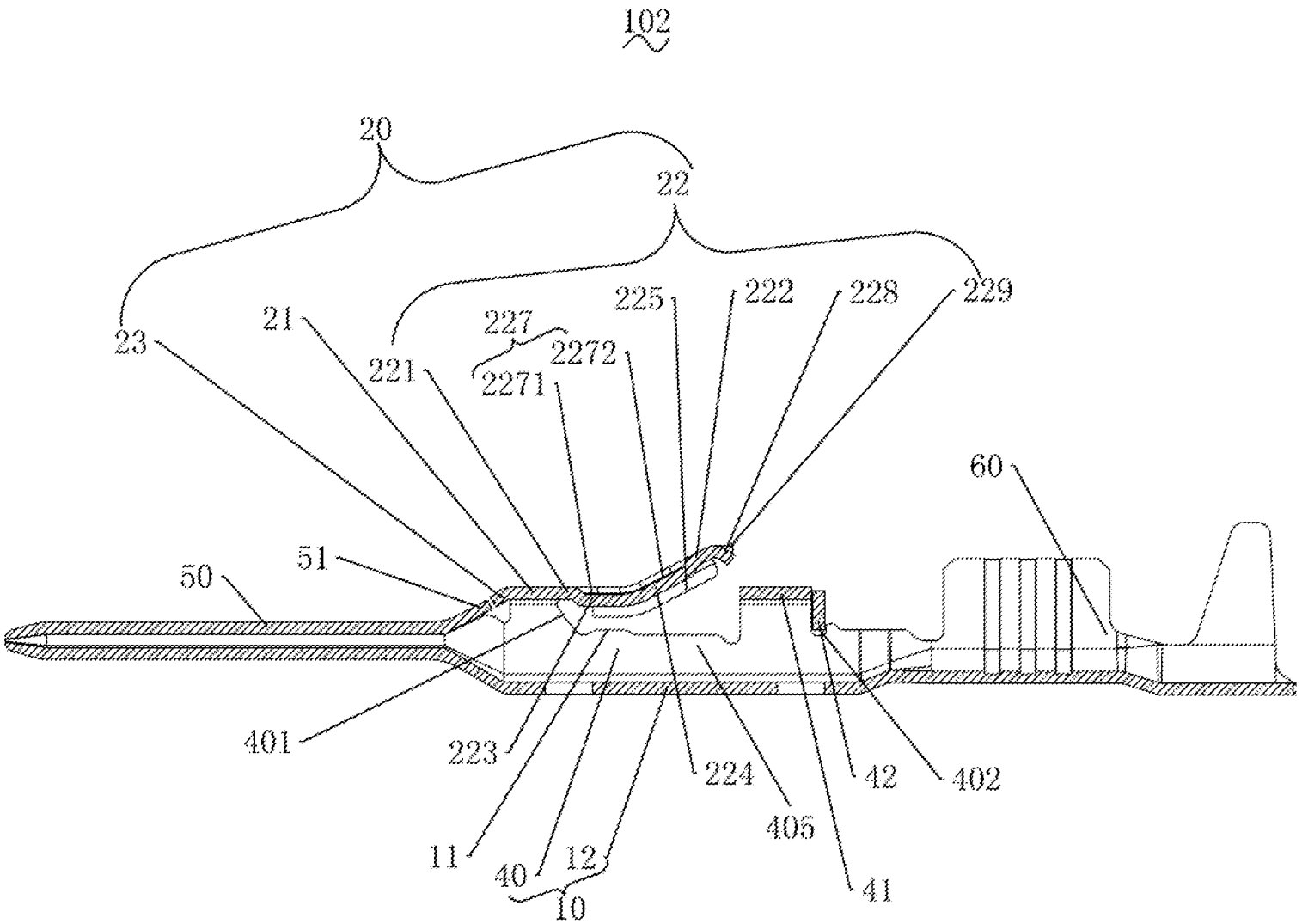
FIG. 11 is a sectional view of a connection terminal along a line B-B in FIG. 3.
Figure 12:
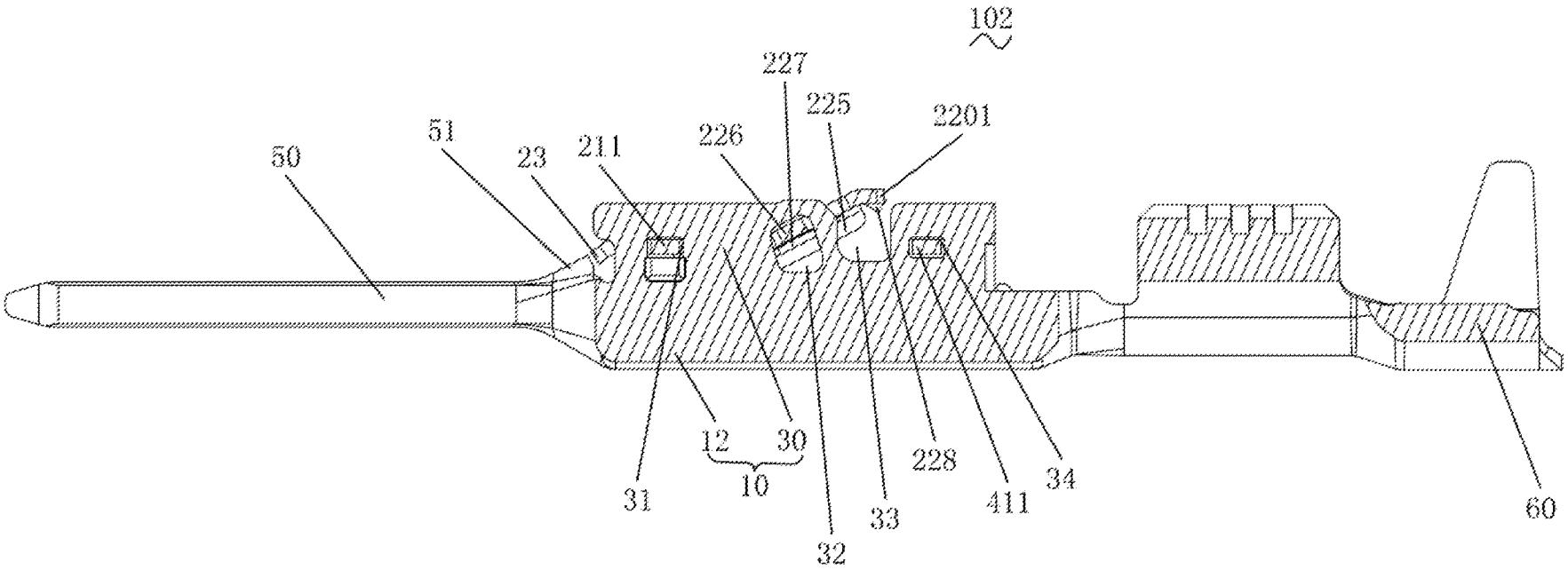
FIG. 12 is a sectional view of a connection terminal along a line E-E in FIG. 5.

Also referring to FIG. 4, FIG. 11 and FIG. 12, the first stopping portion 22 is disposed at a tail end of the connection portion 21 in a protruding manner. It should be noted that, the first stopping portion 22 only needs to be disposed on the body 10 in a protruding manner, for example, an end portion of the first stopping portion 22 is disposed on two side walls of the body 10 in a protruding manner, or on a bottom portion of the groove of the body 10 in a protruding manner, or the like. That the first stopping portion 22 is disposed on the connection portion 21 in a protruding manner is a preferred embodiment of the present invention. That the first stopping portion 22 is disposed on the connection portion 21 in a protruding manner can achieve many beneficial effects, such as facilitating manufacturing, obtaining a greater pressure-bearing capability, and enabling the groove of the body 10 to have a larger accommodation space. As indicated by an angle in FIG. 4, the first stopping portion 22 extends along a direction (the extension direction is a direction indicted by an arrow T2), where an included angle between the direction and the plug-in direction of the connection terminal 102 (the plug-in direction of the connection terminal 102 mentioned in the present invention is a direction indicated by an arrow T1) is an obtuse angle $\alpha$, that is, the first stopping portion 22 tilts toward a position that is behind and above the body 10. The obtuse angle $\alpha$ between the first stopping portion 22 and the plug-in direction of the connection terminal 102 may be selected according to the pressure-bearing capability, an elasticity recovery capability, and a mounting space of the first stopping portion 22.

The first stopping portion 22 has a disposed end 221 and a free end 222. The disposed end 221 of the first stopping portion 22 is disposed on the connection portion 21. The free end 222 of the first stopping portion 22 is the highest relative to the body 10, so as to be urged against a locking structure or the stopping structure in the housing 101, to be pushed down relative to the body 10.

Preferably, the first stopping portion 22 further includes a parallel segment 223 and an inclined segment 224. Areas and shapes of upper surfaces of the parallel segment 223 and the inclined segment 224 only need to enable the parallel segment 223 and the inclined segment 224 to fit and be urged against the stopping structure in the housing 101. The parallel segment 223 is parallel to the support base 12. In this embodiment, one end (that is, a front end) of the parallel segment 223 is disposed on the connection portion 21 by using the disposed end 221. The parallel segment 223 can bear pressure transferred by the inclined segment 224, so as to prevent too great pressure from being transferred to the disposed end 221, thereby enabling connection of the first stopping portion 22 to be more secure. In addition, the parallel segment 223 can increase a contact area between the primary locking portion 20 and an inner cavity wall of the housing 101, so that the primary locking portion 20 is more elastic and is unlikely to lose elastic deformation. Preferably, the one side of the parallel segment 223 directly faces the support protrusion portion 11 on the body 10. The inclined segment 224 is disposed on the other end (or, a rear end) of the parallel segment 223. The inclined segment 224 extends along a direction, where an included angle between the direction and the plug-in direction of the connection terminal 102 is an obtuse angle. The inclined segment 224 is longer than the parallel segment 223, so as to have a relatively large movement range when under the action of a force.

Preferably, the first stopping portion 22 further has a bent side arm 225. The bent side arm 225 is formed by bending the one side of the first stopping portion 22 toward the support base 12. Preferably, the bent side arm 225 is flush with one end of the parallel segment 223 and one end of the inclined segment 224, where the two ends are on a same side, that is, a front end of the bent side arm 225 is spaced from the connection portion 21. The bent side arm 225 can further enhance the pressure-bearing capability of the first stopping portion 22, so as to prevent the first stopping portion 22 from being arched or bent by a force. Preferably, a part, disposed on the one side of the parallel segment 223, of the bent side arm 225 directly faces the support protrusion portion 11 on the support base 10. The bent side wall 225 extends from the first stopping portion 22 to the right along a lateral direction shown in FIG. 13, and extends over an inner side surface 405 of the support wall, so that the support wall 40 can support the bent side wall 225 after supporting the bent side wall 225 to move downward by a distance.

Preferably, a limiting portion 226 is further disposed on the other side of the first stopping portion 22 in a protruding manner. The limiting portion 226 extends towards the other side of the connection terminal 102. The limiting portion 226 extends into the following limiting hole 32 of the mounting side wall 30. The limiting portion 226 may be a protruding block or bar-shaped. The limiting portion 226 is fitted into the limiting hole 32, so as to prevent the first stopping portion 22 from being pushed down or pulled up too much by the stopping structure in the housing 101, otherwise the first stopping portion 22 is damaged. Preferably, the limiting portion 226 is disposed so that a distance from the limiting portion 226 to the free end 222 of the first stopping portion 22 is less than a distance from the limiting portion 226 to the disposed end 221, that is, an arm of force from the free end 222 to the limiting portion 226 is less than an arm of force from the disposed end 221 to the limiting portion 226, and therefore the first stopping portion 22 is enabled to have a greater pressure-bearing capability.

Preferably, the primary locking portion 20 is provided with a reinforcing portion. In an embodiment of the present invention, the reinforcing portion is an inward (or downward) recessed portion disposed on the primary locking portion 20. In another embodiment of the present invention, the reinforcing portion is an outward (or upward) protruding portion disposed on the primary locking portion 20. The reinforcing portion may further be a reinforcing structure such as a raised rib.

Preferably, a reinforcing portion 227 is disposed on the primary locking portion 20. In an embodiment of the present invention, the reinforcing portion 227 is an inward (or downward) recessed portion disposed on the primary locking portion 20. In another embodiment of the present invention, the reinforcing portion 227 is an outward (or upward) protruding portion disposed on the primary locking portion 20. The reinforcing portion 227 may further be a reinforcing structure such as a raised rib.

The reinforcing portion 227 is disposed along the extension direction of the first stopping portion 22. The reinforcing portion 227 can make it easy for the stopping structure in the housing 101 to slip effortlessly to a lower position on the first stopping portion 22, thereby facilitating achievement of a better stopping effect. The reinforcing portion 227 may be oval on an upper portion of the first stopping portion 22. Preferably, the reinforcing portion 227 is made through stamping, that is, the reinforcing portion 227 is recessed on the upper portion of the first stopping portion 22 and protrudes on a lower portion of the first stopping portion 22, thereby enhancing the pressure-bearing capability of the first stopping portion 22. Preferably, the reinforcing portion 227 includes a parallel reinforcing portion 2271 and an inclined reinforcing portion 2272. The parallel reinforcing portion 2271 is parallel to the support base 12. The inclined reinforcing portion 2272 is connected to the parallel reinforcing portion 2271, and is inclined relative to the support base 12, that is, the inclined reinforcing portion 2272 is tilted toward a rear end of the connection terminal 102. In this embodiment, the parallel reinforcing portion 2271 is disposed on the parallel segment 223. The inclined reinforcing portion 2272 is disposed on the inclined segment 224. The parallel reinforcing portion 2271 can share an external force transferred by the inclined reinforcing portion 2272 to the disposed end 221, and increase an arm of force of the disposed end 221, so that the first stopping portion 22 is more securely connected to the connection portion 21.

Preferably, the free end 222 of the first stopping portion 22 is further provided with a guide slot 228. A depth of the guide slot 228 gradually increases in a direction opposite to the plug-in direction of the connection terminal 102. A width of the guide slot 228 is selected according to the stopping structure in the housing 101. An extension length and a maximum depth of the guide slot 228 are selected according to a magnitude of a force on the guide slot 228 and the stopping structure in the housing 101. Preferably, the guide slot 228 is made through stamping.

Preferably, the first stopping portion 22 further includes protruding platforms 229 disposed on two sides of the guide slot 228 respectively. The free end 222 of the first stopping portion 22 further has a stopping surface 2291. The stopping surface 2291 is perpendicular to the plug-in direction of the connection terminal 102. In this embodiment, the stopping surface 2291 is perpendicular to the support base 12, so that when the stopping surface 2291 stops the stopping structure in the housing 101, a contact area is relatively large, and it is more difficult for the first stopping portion 22 to escape from stopping performed by the stopping structure.

Figure 13:
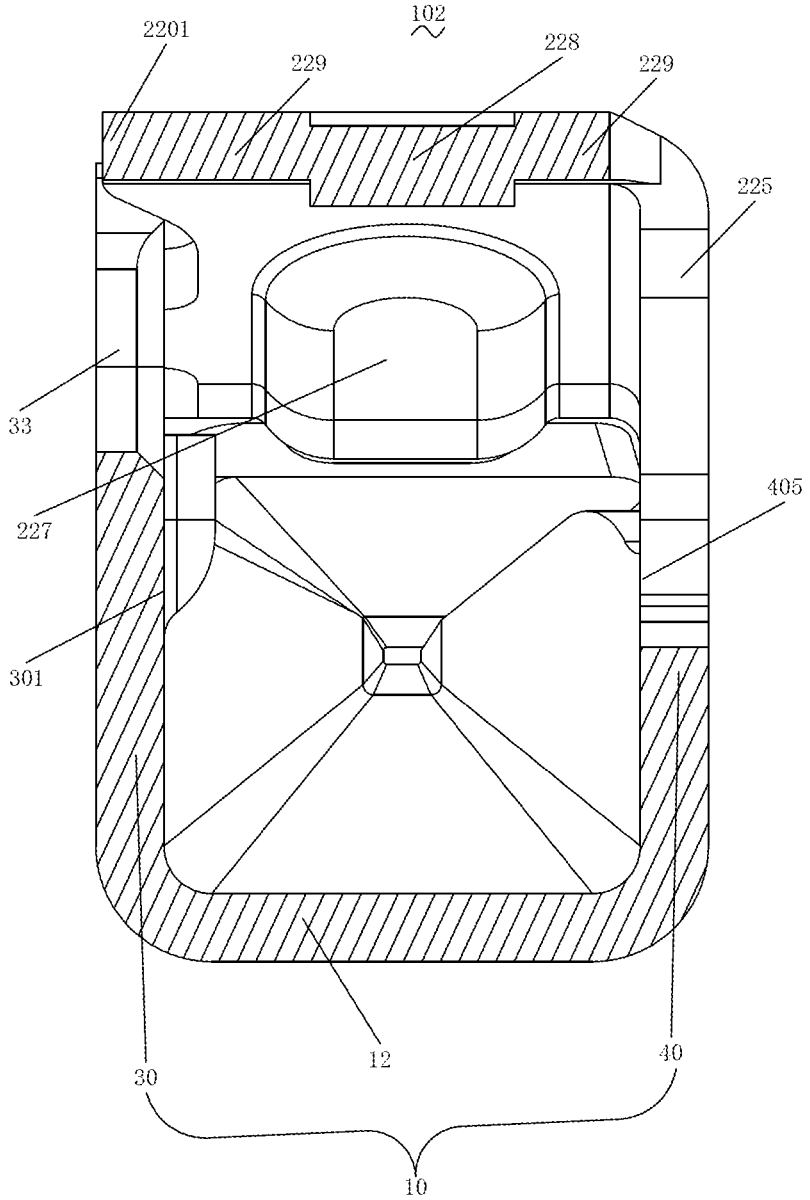
FIG. 13 is a sectional view of a connection terminal along a line F-F in FIG. 5.

Also referring to FIG. 13, preferably, a retaining protrusion portion 2201 is disposed on the other side of the free end 222 of the first stopping portion 22 in a protruding manner. The retaining protrusion portion 2201 extends into the following retaining notch 33 of the mounting side wall 30. The retaining protrusion portion 2201 is used to stop the free end 222 from being excessively pushed down to be damaged. Preferably, the retaining protrusion portion 2201 is flush with the outer side of the mounting side wall 30, so that it is prevented that an insufficient protruding length is likely to cause the retaining protrusion portion 2201 to slip off the retaining notch 33, and in addition, the connection terminal 102 is smooth, and can be assembled easily. Preferably, an upper surface of the retaining protrusion portion 2201 and upper surfaces of the protruding platforms 229 are coplanar, so as to facilitate manufacturing, and make it convenient for a mating connection structure to be mounted and fitted. In an example shown in FIG. 12, the retaining protrusion portion 2201 protrudes from the first stopping portion 22 to the left along the lateral direction, and extends along the lateral direction over the inner side surface 301 of the mounting side wall.

In this embodiment, the guide slot 228 is stamped from one brass sheet. The brass sheet has a uniform thickness and smooth edges. A recessed portion on an edge of the brass sheet forms the guide slot 228, and two sides of the guide slot 228 form the protruding platforms 229. Referring to FIG. 2 to FIG. 12, the retreat prevention protrusion portion 23 is disposed at a front end of the connection portion 21 in a protruding manner The retreat prevention protrusion portion 23 is used to support the plug-in portion 50 so as to prevent the plug-in portion 50 from retreating when the plug-in portion 50 encounters relatively great resistance, so that the plug-in portion 50 can overcome the relatively great resistance to be plugged in.

Figure 5:
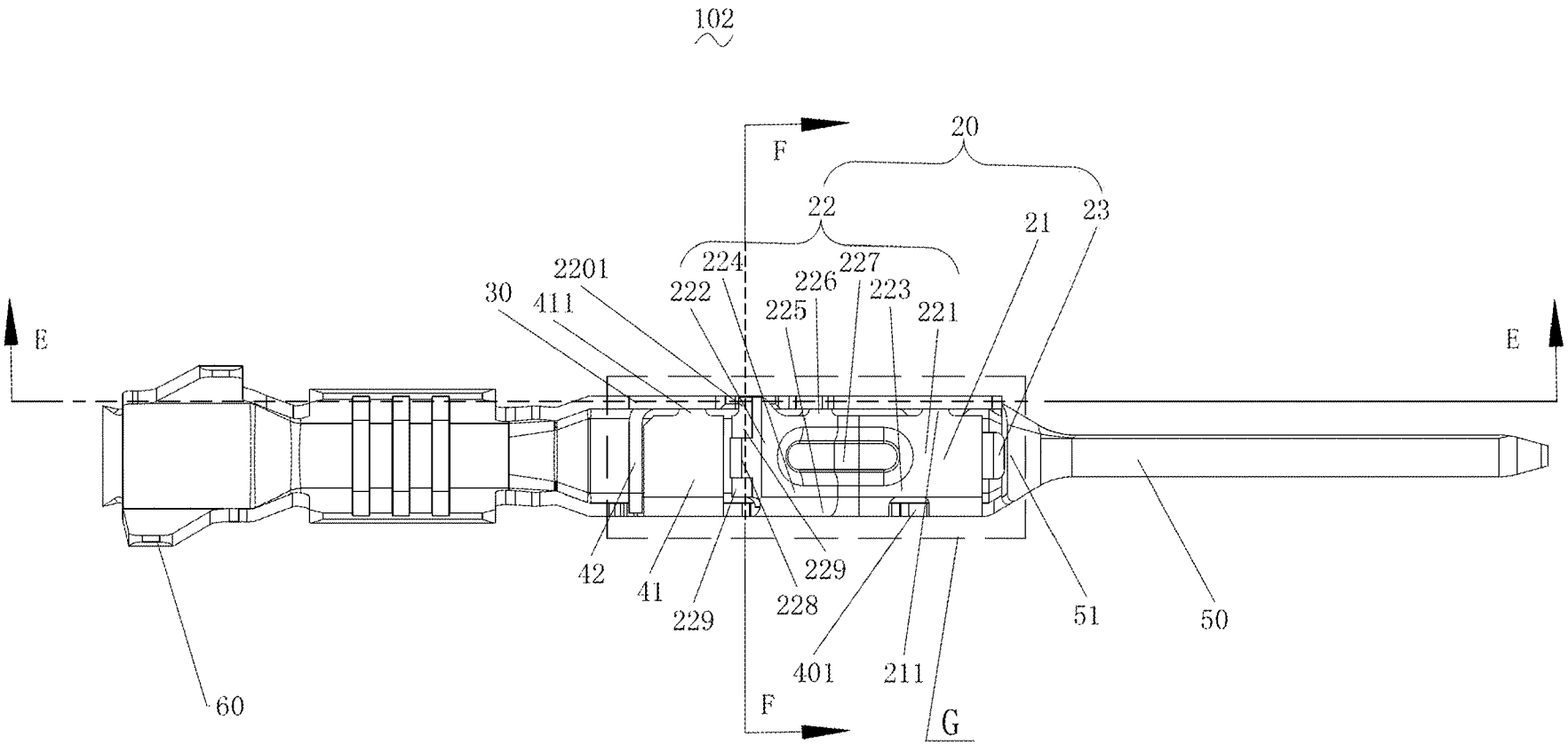
FIG. 5 is a top view of a connection terminal along a direction indicated by an arrow X in FIG. 4.
Figure 6:
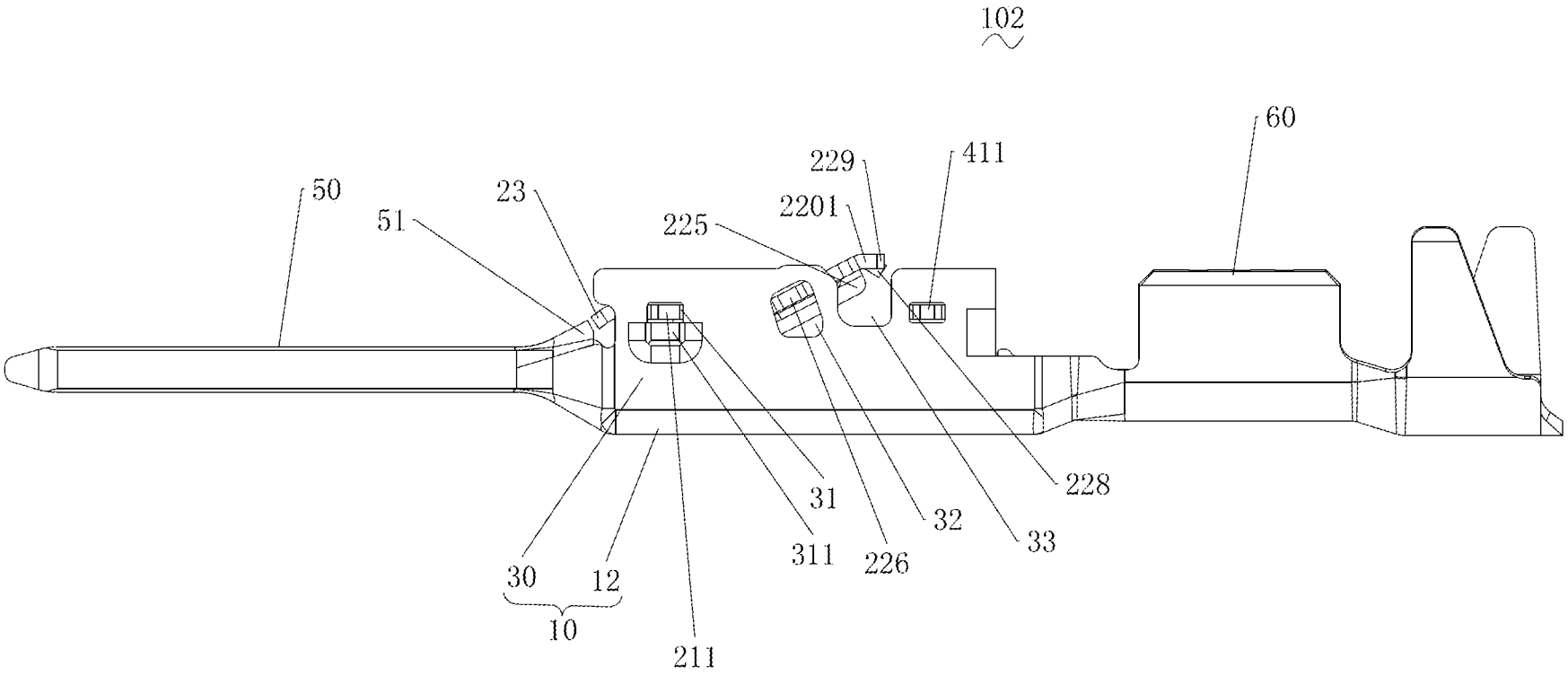
FIG. 6 is a front view of one side of a connection terminal in FIG. 2.
Figure 7:
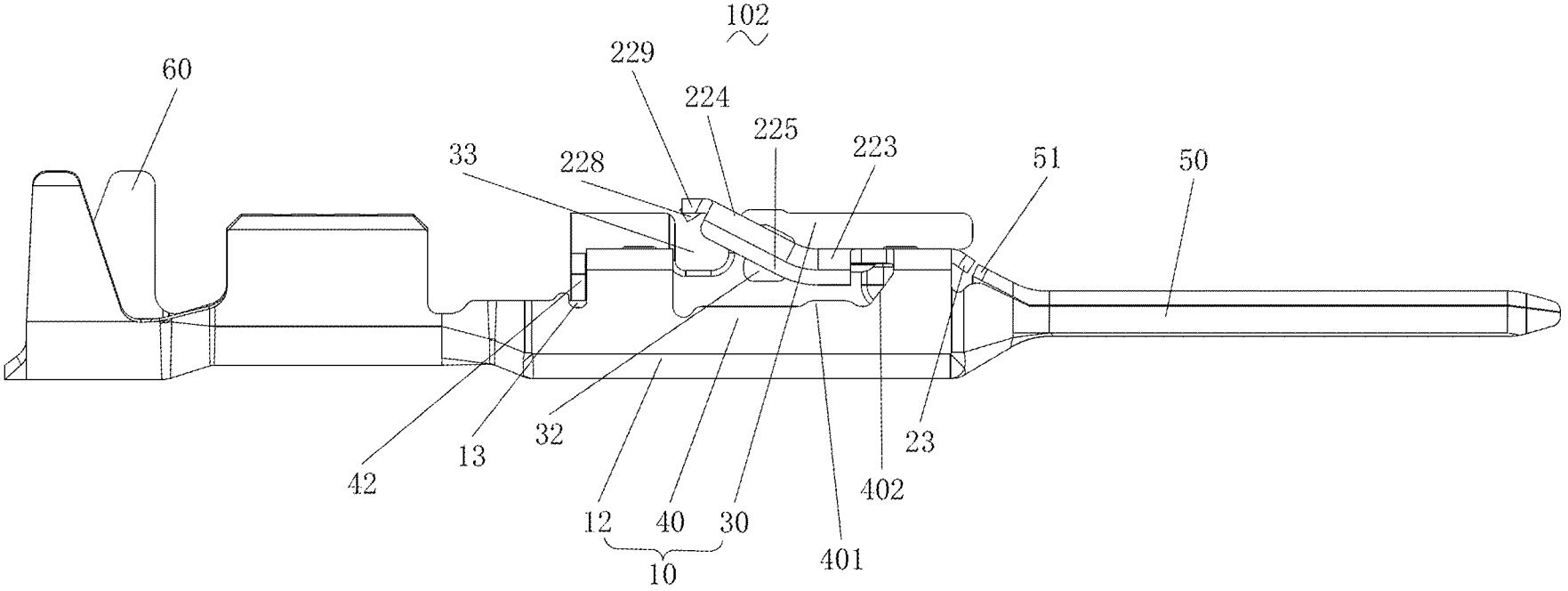
FIG. 7 is a front view of the other side of a connection terminal in FIG. 6.
Figure 8:
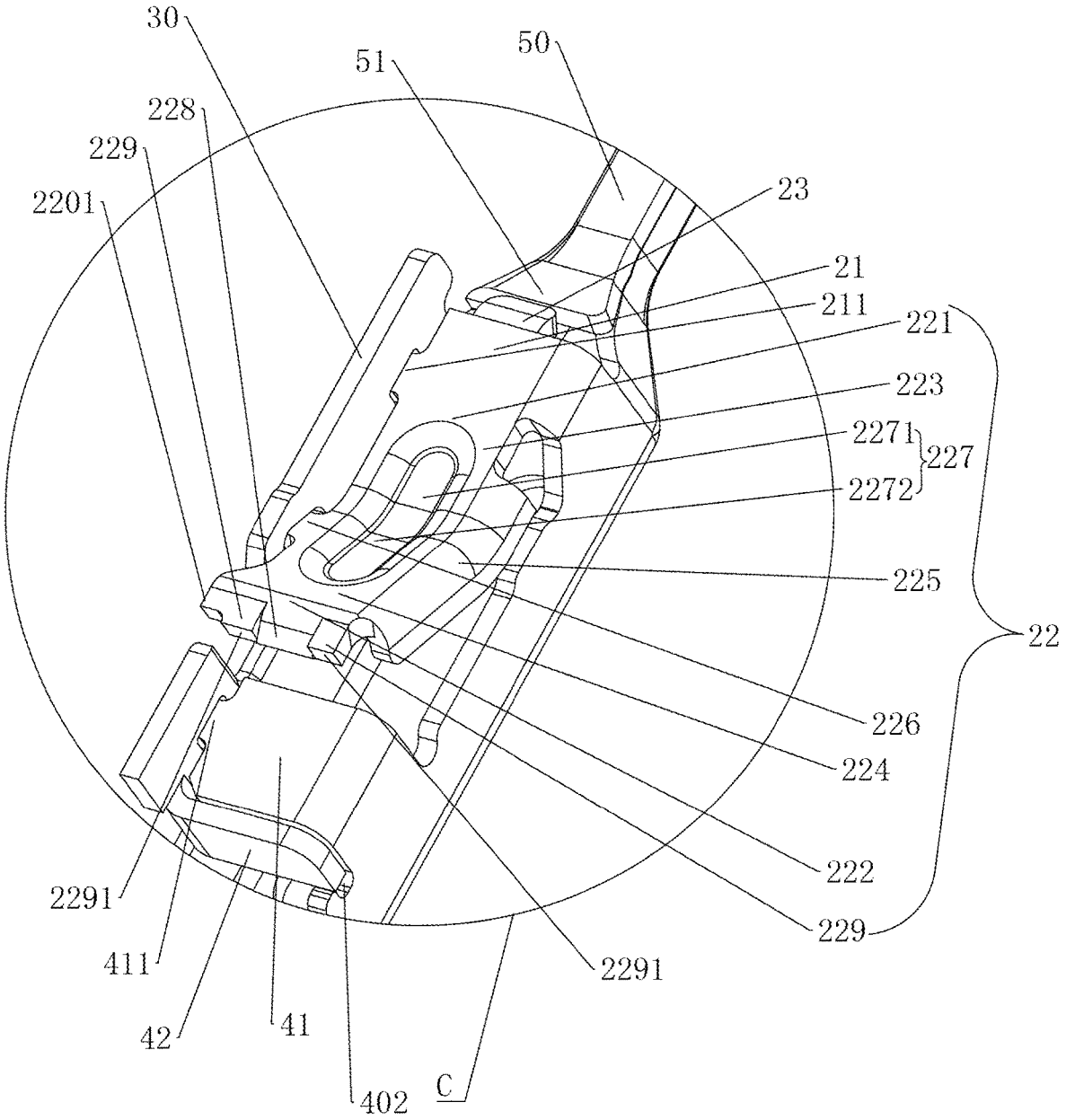
FIG. 8 is an enlarged schematic view of a position C in FIG. 3.
Figure 9:
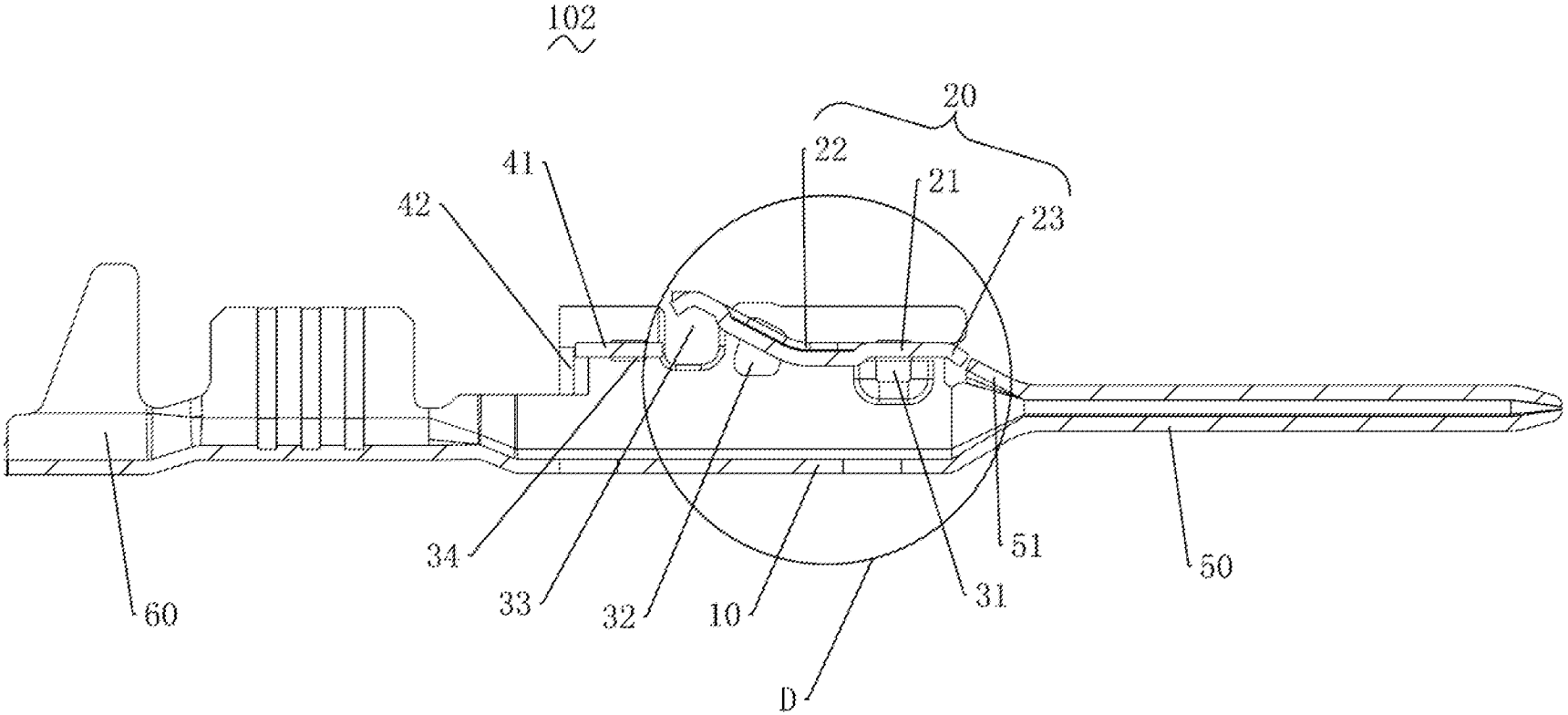
FIG. 9 is a sectional view of a connection terminal along a line A-A in FIG. 3.
Figure 10:
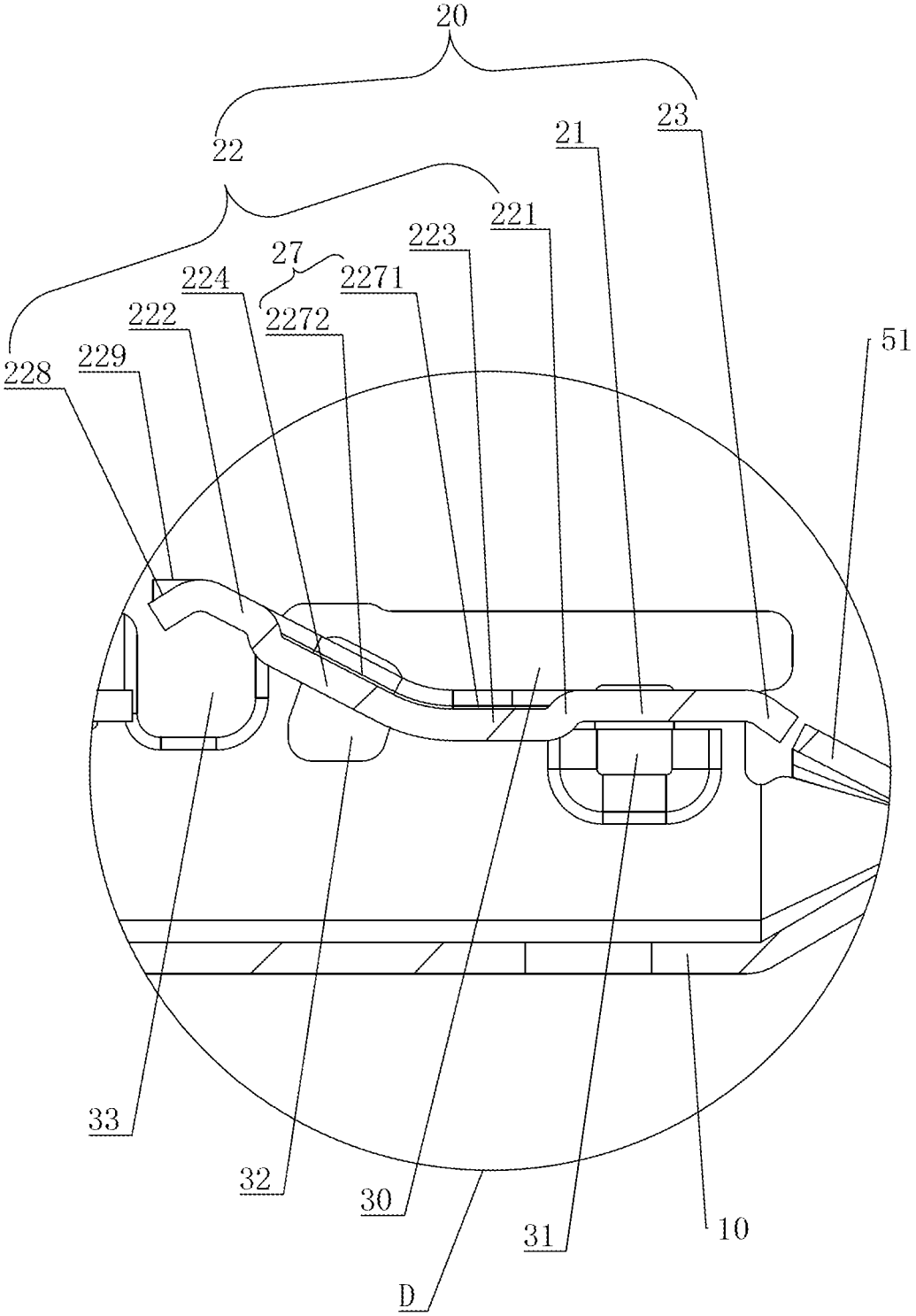
FIG. 10 is an enlarged schematic view of a position D in FIG. 9.

Referring to FIG. 5, in this embodiment, a lateral clearance (not numbered in the drawing) is disposed between the primary locking portion 20 and the mounting side wall 30, and the lateral clearance is uniform along the plug-in direction of the connection terminal 102. The lateral clearance provides the primary locking portion 20 with an expansion and contraction margin when the primary locking portion 20 expands because of being heated or the like. In addition, the lateral clearance facilitates manufacturing of the primary locking portion 20, and especially facilitates formation of a single piece through stamping and bending.

Referring to FIG. 2 to FIG. 12, the mounting side wall 30 is disposed on the other side of the support base 12. A height of the mounting side wall 30 only needs to enable that a corresponding hole and groove can be disposed thereof to support the primary locking portion 20. The mounting side wall 30 is used to be fitted into the slots in the housing 101, so that the connection terminal 102 can be mounted in the housing 101 only in a correct manner that the support base 12 is below the primary locking portion 20, so as to prevent that the connection terminal 102 cannot work normally because of being mounted in another wrong manner, and prevent the connection terminal 102 from being damaged due to unnecessary squeeze from the housing 101.

In this embodiment, the inner side of the mounting side wall 30 is provided with the first support hole 31. The first support hole 31 and the first protrusion portion 211 on the connection portion 21 form a fit, so as to support the connection portion 21. Preferably, the first support hole 31 and the first protrusion portion 211 form a clearance fit, so that it is easier to manufacture the connection terminal 102, that is, the connection terminal 102 is easily bendable, and the first protrusion portion 211 has a relatively large movement margin. It should be noted that, if not otherwise specified, the "clearance fit" mentioned in the present invention refers to that there is a gap, and a size of the gap only needs to meet mounting requirements and enable movement.

The inner side of the mounting side wall 30 is further provided with the limiting hole 32. The limiting hole 32 and the limiting portion 226 on the first stopping portion 22 form a fit, so as to further support the primary locking portion 20. A center of the limiting hole 32 is disposed so that along a direction parallel to the support base 10, a distance from the center of the limiting hole 32 to the free end 222 of the first stopping portion 22 is less than a distance from the center of the limiting hole 32 to the disposed end 221, that is, an arm of force from the free end 222 to the center of the limiting hole 32 is less than an arm of force from the disposed end 221 to the center of the limiting hole 32. Preferably, the limiting hole 32 has a front edge. The front edge is a hole wall, close to the plug-in portion 50, of the limiting hole 32. The front edge of the limiting hole 32 is disposed so that when the first stopping portion 22 is pushed down by a force, the front edge of the limiting hole 32 comes into contact with the limiting portion 226, so as to prevent the limiting portion 226 from being excessively offset. The first stopping portion 22 is located between the mounting side wall 30 and the support wall 40, and the limiting portion 226 extends from the first stopping portion 22 to the left along the lateral direction shown in FIG. 13, and extends over an inner side surface 301 of the mounting side wall, so that after the limiting portion 226 moves downward by a distance, the mounting side wall 30 can support the limiting portion 226 and the retaining protrusion portion 2201.

Preferably, the mounting side wall 30 is further provided with the retaining notch 33 or a retaining groove. The retaining notch 33 and the retaining protrusion portion 2201 form a fit to prevent the free end 222 of the first stopping portion 22 from being excessively pushed down to cause the free end 222 to lose an elastic deformation capability. The retaining groove is disposed along a movement path of the retaining protrusion portion 2201. A depth of the retaining notch 33 or the retaining groove is selected according to a range within which the free end 222 can be safely pushed down. Preferably, the retaining notch 33 enables a greater protruding and extension length of the retaining protrusion portion 2201, so that the retaining protrusion portion 2201 can be securely supported, and is unlikely to slip. In this embodiment, the retaining notch 33 is formed by a retaining hole wall disposed on the mounting side wall 30, and a height of a bottom edge of the retaining hole wall is set so that when the bottom edge of the retaining hole wall comes into contact with the retaining protrusion portion 2201, the bottom edge of the retaining hole wall prevents the first stopping portion 22 from being excessively offset. The first stopping portion 22 is located between the mounting side wall 30 and the support wall 40, and the retaining protrusion portion 2201 extends from the first stopping portion 22 to the left along the lateral direction shown in FIG. 13, and extends over the inner side surface 301 of the mounting side wall, so that after the retaining protrusion portion 2201 moves downward by a distance, the mounting side wall 30 can support the retaining protrusion portion 2201.

Preferably, the mourning side wall 30 is further provided with a second support hole 34. The second support hole 34 is used to support the following second stopping portion 41. Specifically, the second support hole 34, the retaining notch 33, the limiting hole 32, and the first support hole 31 are successively arranged along the plug-in direction of the connection terminal 102. In addition, the second support hole 34, the limiting hole 32, and the first support hole 31 may be blind holes or through holes that are disposed on the inner side of the mounting side wall 30 and that extend toward the outer side. Preferably, the second support hole 34, the limiting hole 32, and the first support hole 31 may be through holes that are disposed on the inner side of the mounting side wall 30 and that extend toward the outer side, so that extension lengths of corresponding protrusion portions are greater, thereby achieving better securing and limiting performance.

The mounting side wall 30 is further provided with an inward recessed portion 311 disposed at a lower portion of the first support hole 31. The inward recessed portion 311 is recessed from the outer side of the mounting side wall 30 to the inner side through stamping, that is, recessed from the mounting side wall 30 to the support wall 40 on the opposite side. When supporting the first protrusion portion 211 of the connection portion 21, the inward recessed portion 311 not only has a greater mechanical pressure-bearing capability, but also enables the first protrusion portion 211 to be more unlikely to slip. Referring to FIG. 2 to FIG. 12, the second stopping portion 41 is disposed on the support wall in a protruding manner. A height from the second stopping portion 41 to the support base 12 is less than a height from the first stopping portion 22 to the support base 12, so that the connection terminal 102 has an upper space for accommodating the stopping structure that is in the housing 101 and that is used to stop the first stopping portion 22. The second stopping portion 41 is used to form a fit with a secondary stopping structure in the housing 101 to implement secondary locking of the connection terminal 102, so as to further improve secure mounting performance of the connection terminal 102. In this embodiment, the second stopping portion 41 is bent from the one side of the support base 12 to the other side. Preferably, the second stopping portion 41 has a protruding disposed portion 411. The protruding disposed portion 411 extends toward the other side of the support base 12. The protruding disposed portion 411 is inserted into the second support hole 34. Preferably, the protruding disposed portion 411 is flush with the outer side of the mounting side wall 30, so that the second stopping portion 41 has stable pressure-bearing performance, and the mounting side wall 30 has the smooth outer side, and can be mounted easily.

Referring to FIG. 2 to FIG. 12, the third stopping portion 42 is disposed on the support base 12. The third stopping portion 42, the second stopping portion 41, and the first stopping portion 22 are successively arranged along the plug-in direction of the connection terminal 102. The third stopping portion 42 directly faces a rear portion of the second stopping portion 41. An area of a projection of the third stopping portion 42 on a cross section of the connection terminal 102 is greater than an area of a projection of the second stopping portion 41 on the cross section of the connection terminal 102, so that when the third stopping portion 42 is urged against the secondary stopping structure in the housing 101, a greater contact area is achieved, thereby improving the stability of the connection terminal 102 when disposed in the housing 101. Preferably, the third stopping portion 42 is bent from, the other side of the support base 12 to the one side of the support base 12. The third stopping portion 42 extends into the limiting notch 402 on the one side of the support base 12, so that the third stopping portion 42 is unlikely to move, so as to be secure.

Referring to FIG. 2 to FIG. 12, the plug-in portion 50 is used to form a plug-in fit with a male terminal or a socket. A shape and specifications of the plug-in portion 50 are selected according to plug-in requirements. The plug-in portion 50 may be column-shaped. Preferably, the plug-in portion 50 is formed by performing stamping on a sheet metal and forming a rectangular column through folding. In this embodiment, the sheet metal is brass that has a uniform thickness. A top end of the plug-in portion 50 may be a triangular pyramid or cone. In this embodiment, the top end of the plug-in portion 50 is a rectangular pyramid. The rear end of the plug-in portion 50 is provided with a retreat prevention portion 51. The retreat prevention portion 51 directly faces the retreat prevention protrusion portion 23 of the primary locking portion 20. The retreat prevention portion 51 and the retreat prevention protrusion portion 23 form a fit, so that the plug-in portion 50 has a relatively great pressure-bearing capability when encountering relatively great resistance.

Referring to FIG. 11, in which the numeral 405 indicates the inner side surface of the support wall 40. Referring to FIG. 12 and FIG. 13, the support portion extends from the first stopping portion 22 along the lateral direction, and extends over the inner side surface 301 of the mounting side wall or the inner side surface 405 of the support wall, that is, the support portion can protrude laterally to be supported by the mounting side wall 30 and/or the support wall 40, so that the support portion can be supported by the mounting side wall 30 or the support wall 40 rather than be supported through welding, and therefore a pressure-bearing capability of the support portion is enhanced. In this embodiment, the support portion includes the bent side wall 225, the limiting portion 226, and the retaining protrusion portion 2201.

Referring to FIG. 2 to FIG. 7, FIG. 9, FIG. 11, and FIG. 12, the wire connecting portion 60 is disposed at a rear portion of the body 10. The wire connecting portion 60 is used to connect a wire. A shape and a structure of the wire connecting portion 60 are selected according to winding and mounting requirements.

Preferably, the connection terminal 102 is a single piece formed through stamping. The connection terminal 102 may be made of any conductive material, for example, iron, steel, or an alloy. In this embodiment, the connection terminal 102 is a single piece stamped from a brass sheet that has a uniform thickness. The connection terminal 102 is made of brass, so that not only pressure-bearing strength required by a product is achieved, but also material costs are reduced.

Compared with the prior art, the connection terminal 102 of the present invention has high mechanical strength and a high pressure-bearing capability, so as to be securely mounted in a housing. Preferably, the connection terminal 102 of the present invention is integrally formed by using brass, so that not only manufacturing costs are reduced, but also required mechanical strength is achieved. A mounting side wall 30 of the connection terminal 102 not only provides a correct mounting direction, but also is provided with a corresponding hole and notch to support other parts. In addition, a limiting hole 32 disposed in the mounting side wall 30 provides a supporting point for a first stopping portion 22 subjected to a force, and enables an arm of force of a free end of the first stopping portion 22 to be relatively short, thereby enabling the free end to bear greater pressure. A reinforcing portion 227 on the connection terminal 102 is further formed through stamping, thereby further improving an anti-bending capability of the first stopping portion 22. One side of the first stopping portion 22 is provided with a bent side wall 225, so as to further prevent the first stopping portion 22 from being arched or bent. In addition, a primary locking portion 20 of the connection terminal forms a fit with a second stopping portion 41 and a third stopping portion 42, to form a secondary locking structure, thereby further improving secure mounting performance. A front portion of the primary locking portion 20 of the connection terminal 102 is provided with a retreat prevention protrusion portion 23, so as to provide a support when a plug-in portion 50 is subjected to a relatively great squeezing force.

The foregoing descriptions are merely preferred embodiments of the present invention, but not intended to limit the protection scope of the present invention. Any modification, equivalent replacement, or improvement made without departing from the spirit of the present invention shall fall within the scope of the claims of the present invention.

The invention claimed is:

1. A connection terminal, comprising a body, a plug-in portion, and a wire connecting portion, wherein the plug-in portion and the wire connecting portion are disposed at two ends of the body respectively;

the body is provided with a primary locking portion, which comprises a connection portion, a first stopping portion, and a reinforcing portion;

the connection portion is disposed on the body;

the first stopping portion is disposed on the connection portion, and extends in a direction opposite to a plug-in direction;

the reinforcing portion is disposed on the first stopping portion, and extends continuously along the plug-in direction of the connection terminal to the connection portion;

the body comprises a support base, and a mounting side wall and a support wall that are disposed on two sides of the support base;

the connection portion is disposed on the support wall, and extends toward the mounting side wall;

the support wall is formed with a second stopping portion in a protruding manner; and the second stopping portion and the first stopping portion are successively arranged in the plug-in direction of the connection terminal with the second stopping portion rearward of the first stopping portion, the second stopping portion being profiled to prevent excessive downward deflection of the first stopping portion and with a maximum height from the second stopping portion to the support base being less than a height from a free end of the first stopping portion to the support base.

2. The connection terminal according to claim 1, wherein the connection portion has a first protrusion portion disposed in a protruding manner, and the first protrusion portion extends toward the mounting side wall;

the mounting side wall is provided with a first support hole, and the first support hole is a blind hole or a through hole that is disposed on an inner side of the mounting side wall and that extends toward an outer side; and the first protrusion portion is inserted into the first support hole, so as to connect the connection portion to the mounting side wall.

3. The connection terminal according to claim 2, wherein a clearance fit is formed between the first protrusion portion and a hole wall of the first support hole.

4. The connection terminal according to claim 2, wherein a lower portion of the first support hole is provided with an inward recessed portion, and an upper portion of the inward recessed portion is in contact with the first protrusion portion.

5. The connection terminal according to claim 1, wherein one side of the first stopping portion is provided with a bent side arm, and the bent side arm is bent toward the support base.

6. The connection terminal according to claim 5, wherein the support wall is provided with a support protrusion portion, and the support protrusion portion extends toward the bent side arm, and directly faces the bent side arm.

7. The connection terminal according to claim 1, wherein the first stopping portion has an upper portion and a lower portion that are opposite to each other, the back of the upper portion faces the support base, the lower portion directly faces the support base, and the reinforcing portion comprises a recessed portion that recesses downward from the upper portion of the first stopping portion.

8. The connection terminal according to claim 1, wherein the mounting side wall is further provided with a retaining notch, and a retaining protrusion portion is disposed on a corresponding side of a free end of the first stopping portion in a protruding manner, and the retaining protrusion portion extends into the retaining notch.

9. The connection terminal according to claim 8, wherein the free end of the first stopping portion is provided with a protruding platform, and an upper surface of the retaining protrusion portion and an upper surface of the protruding platform are coplanar.

10. The connection terminal according to claim 1, wherein a limiting portion is disposed on the other side of the first stopping portion in a protruding manner;

the mounting side wall is provided with a limiting hole, and the limiting hole is a through hole or a blind hole that is disposed on an inner side of the mounting side wall and that extends toward an outer side;

the limiting portion is inserted into the limiting hole; and the limiting hole is used to limit a movement range of the limiting portion, so as to limit a range of a distance from the first stopping portion to the support base.

11. The connection terminal according to claim 1, wherein the second stopping portion extends toward the mounting side wall, and has a protruding disposed portion;

the mounting side wall is provided with a second support hole, and the second support hole is a blind hole or a through hole that is disposed on an inner side of the mounting side wall and that extends toward an outer side; and the protruding disposed portion is inserted into the second support hole.

12. The connection terminal according to claim 1, wherein the connection terminal further comprises a third stopping portion, and the third stopping portion is disposed on the support base;

the third stopping portion, the second stopping portion, and the first stopping portion are successively arranged along the plug-in direction of the connection terminal; and the third stopping portion directly faces a rear portion of the second stopping portion, and a projection area of the third stopping portion on a cross section of the connection terminal is greater than a projection area of the second stopping portion on the cross section of the connection terminal.

13. The connection terminal according to claim 12, wherein the third stopping portion extends from the mounting side wall to the support wall;

the support wall is provided with a limiting notch; and the third stopping portion is inserted into the limiting notch.

14. The connection terminal according to claim 1, wherein a lateral clearance is disposed between the primary locking portion and the mounting side wall, and the lateral clearance is uniform along the plug-in direction of the connection terminal.

15. The connection terminal according to claim 1, wherein the support wall comprises an inclined end surface, and the inclined end surface is located at a junction of the support wall and the primary locking portion, and is inclined downward and backward.

16. The connection terminal according to claim 1, wherein the connection terminal is an integral single piece.

17. A connection terminal, comprising a body, a plug-in portion, and a wire connecting portion, wherein the plug-in portion and the wire connecting portion are disposed at two ends of the body respectively;

the body is generally box-shaped and comprises a support base, and a mounting side wall and a support wall that are integrally disposed on two sides of the support base, and a top wall integrally coupled with the support wall and is coupled to the mounting side wall;

the top wall of the body is provided with a primary locking portion;

the primary locking portion comprises a connection portion and a first stopping portion, the first stopping portion, when undeflected, upstands above the mounting side wall and support wall;

the connection portion is disposed on the top wall of the body;

the first stopping portion is disposed on the connection portion, and extends in a direction opposite to a plug-in direction, the first stopping portion extending rearwardly from a rear portion of the top wall;

the first stopping portion is provided with a support portion, and the support portion protrudes from the first stopping portion along a lateral direction, and extends to a position above the support wall; and the support wall is formed with a second stopping portion in a protruding manner, and the second stopping portion being profiled to prevent excessive downward deflection of the first stopping portion and with a maximum height from the second stopping portion to the support base being less than a height from a free end of the first stopping portion to the support base.

18. The connection terminal according to claim 17, wherein the first stopping portion is located between the mounting side wall and the support wall, and the support portion extends from the first stopping portion along the lateral direction, and extends over an inner side surface of the mounting side wall or an inner side surface of the support wall.

19. The connection terminal according to claim 17, wherein the support portion is disposed on two lateral sides of the first stopping portion.

20. The connection terminal according to claim 17, wherein the support portion comprises a bent side arm, the bent side arm is connected to the first stopping portion and located on one side of the first stopping portion, and the bent side arm is bent towards the support base.

21. The connection terminal according to claim 20, wherein the support wall is provided with a support protrusion portion, and the support protrusion portion extends toward the bent side arm, and directly faces the bent side arm.

22. The connection terminal according to claim 17, wherein the support portion comprises a retaining protrusion portion; the retaining protrusion portion is disposed at a free end of the first stopping portion, and protrudes toward one side of the first stopping portion; the mounting side wall is further provided with a retaining notch; and the retaining protrusion portion extends into the retaining notch.

23. The connection terminal according to claim 17, wherein the support portion comprises a limiting portion disposed on the first stopping portion and protruding toward the other side of the first stopping portion;

the mounting side wall is provided with a limiting hole, and the limiting hole is a through hole or a blind hole that is disposed on an inner side of the mounting side wall and that extends toward an outer side;

the limiting portion is inserted into the limiting hole; and the limiting hole is used to limit a movement range of the limiting portion, so as to limit a range of a distance from the first stopping portion to the support base.

24. A connection assembly, comprising a housing and a connection terminal according to claim 1, wherein the connection terminal is disposed in the housing.

25. A connection terminal, comprising:

a body comprising a support base, a mounting side wall and a support wall that are disposed on two sides of the support base;

a primary locking portion being provided on the body and comprising a connection portion, a first stopping portion, and a reinforcing portion;

a plug-in portion;

a wire connecting portion, wherein the plug-in portion and the wire connecting portion are disposed at two ends of the body respectively;

the connection portion is disposed on the support wall, and extends toward the mounting side wall;

the first stopping portion is disposed on the connection portion, and extends in a direction opposite to a plug-in direction;

the reinforcing portion is disposed on the first stopping portion, and extends continuously along the plug-in direction of the connection terminal to the connection portion;

a second stopping portion disposed on the support wall in a protruding manner, the second stopping portion and the first stopping portion are successively arranged along the plug-in direction of the connection terminal, and a maximum height from the second stopping portion to the support base is less than a height from a free end of the first stopping portion to the support base; and a third stopping portion disposed on the support base, the third stopping portion, the second stopping portion, and the first stopping portion are successively arranged along the plug-in direction of the connection terminal; and the third stopping portion directly faces a rear portion of the second stopping portion, and a projection area of the third stopping portion on a cross section of the connection terminal is greater than a projection area of the second stopping portion on the cross section of the connection terminal.

26. The connection terminal according to claim 25, wherein the third stopping portion extends from the mounting side wall to the support wall;

the support wall is provided with a limiting notch; and the third stopping portion is inserted into the limiting notch.

* * * * *